US006135402A

United States Patent [19]

Hatano et al.

[11] Patent Number: 6,135,402

[45] Date of Patent: Oct. 24, 2000

[54] DEVICE FOR FITTING OUTDOOR UNIT OF SEPARATE TYPE AIR CONDITIONER

[75] Inventors: Koji Hatano, Otsu; Mitsuo Nakanuma, Shiga, both of Japan

[73] Assignee: Matsushita Electric Industrial Co., Ltd., Osaka, Japan

[21] Appl. No.: 09/171,552

[22] PCT Filed: Feb. 17, 1998

[86] PCT No.: PCT/JP98/00654

§ 371 Date: Nov. 16, 1998

§ 102(e) Date: Nov. 16, 1998

[87] PCT Pub. No.: WO98/36226

PCT Pub. Date: Aug. 20, 1998

[30] Foreign Application Priority Data

Feb. 17, 1997 [JP] Japan ..... 9-031967

[51] Int. Cl.[7] ..... A47F 5/00

[52] U.S. Cl. ..... 248/207; 248/205.1; 248/206.1; 248/235; 248/247; 248/263

[58] Field of Search ..... 248/235, 247, 248/237, 263, 205.1, 206.1, 207

[56] References Cited

U.S. PATENT DOCUMENTS

| | | | |
|---|---|---|---|
| 1,645,853 | 10/1927 | Crawford | 248/233 |
| 1,773,188 | 8/1930 | Kehm | 248/233 |
| 1,794,949 | 3/1931 | Frank | 248/233 |
| 1,827,540 | 10/1931 | O'Connell | 248/233 |
| 1,878,187 | 9/1932 | Ruff, 2nd | 248/233 |
| 1,951,331 | 3/1934 | Kelly | 248/209 |
| 2,782,007 | 2/1957 | Glatt | 257/133 |
| 4,862,953 | 9/1989 | Granetzke et al. | 248/213.3 |

FOREIGN PATENT DOCUMENTS

| | | | |
|---|---|---|---|
| 664157 | 4/1964 | Canada | 248/209 |
| 58-119166 | 8/1983 | Japan . | |
| 59-185572 | 12/1984 | Japan . | |
| 2-91300 | 7/1990 | Japan . | |
| 2-114829 | 9/1990 | Japan . | |
| 195716 | 3/1964 | Sweden | 248/233 |

*Primary Examiner*—Ramon O. Ramirez
*Assistant Examiner*—Walter Landry
*Attorney, Agent, or Firm*—Ratner & Prestia

[57] ABSTRACT

An unit installation tool for a separate type air conditioner is capable of installing the output unit easily and safely on the outer wall, and preventing shaking or swaying. A yoke is fitted to the outer wall with bolts. A holding part extended laterally is provided in the upper part of this yoke. The holding part has a first engaging part provided in the upper part of the rear surface of the unit engaged from above, for stopping it from beneath, and a position keeping part provided below the first engaging part of the yoke, having a second engaging part provided beneath the first engaging part of the unit engaged from above, for defining the longitudinal movement of the lower side of the unit.

35 Claims, 5 Drawing Sheets

DEVICE FOR FITTING OUTDOOR UNIT OF SEPARATE TYPE AIR CONDITIONER

This application is a U.S. National Phase Application of PCT International Application PCT/JP98/00654 Feb. 17, 1998.

TECHNICAL FIELD

The present invention relates to an outdoor unit installation tool for an individual type air conditioner. In particular, a tool is disclosed which is appropriate for installing the outdoor unit of an individual type air conditioner on an outer wall beneath a window or the like.

BACKGROUND ART

As shown in FIG. 7, an outdoor unit 51 of an individual type air conditioner accommodates many component devices (e.g. a heavy compressor 53) in a box 52 in order to decrease the number of components of the indoor unit (not shown) effectively, and to obtain a reduction in weight and size. Accordingly, the outdoor unit 51 is heavier than the indoor unit. Hence, it is generally installed on a bench placed on the ground, verandah or roof, by making use of mounting bases 54 attached to the bottom. The mounting base 54 has a mounting hole 54*a* adjacent to the bench, and is bolted firmly. Depending on the case, however, if there is no space for placing the bench, the unit 51 is installed on the outer wall.

In such installation, hitherto, a stand 56 having a mounting part 55 to be mounted on the outer wall with bolts 57 as shown in FIG. 7 is used.

However, in such a conventional method of installation, the stand 56 has mounting holes 56*a* corresponding to mounting holes 54*a* of the mounting bases 54 of the unit 51, and corresponding bolts 58 passing in them and nuts 59 to be engaged with these bolts 58 are tightened to support. Such a job is done, however, on an elevated place, and the mounting holes 54*a* at the heavy unit 51 side must be positioned precisely to the mounting holes 56*a* of the stand 56. Accordingly, this job is accompanied by heavy labor and is slow in progress. Or, when installing the unit 51 on a place remote from the ground, such as the outer wall of a high-rise building, a scaffold may be required to be erected prior to installation, or the nit 51 may be required to be lifted and suspended by a rope or the like, while the complicated job is done. This required much labor. If, by stretching out hands from within the window, if the stand 56 can be mounted on the outer wall of the building beneath the window, since the installation job of the unit 51 on the stand 56 is mainly done in the bottom of the unit 51, the worker may be required to go out of the window to reach beneath or ahead of the unit 51.

Or, in order to do the installation job from within the window "A", as shown in FIG. 4 to FIG. 6, it may be considered to use an installation tool 42 having a mounting part 43 to the window opening "B" of the outer wall and a holding part 44 of the unit 41 extended laterally. That is, by mounting this installation tool 42 on the window opening "B" of the outer wall by using bolts 49, an engaging part 46 provided in the upper part of the back side of the unit 41 supports holding part 44 from beneath. An abutting bolt 47 adjustable in length in the longitudinal direction provided in the lower part of the back side of the unit 41 is fitted to the outer wall C to limit backward deflection. Tightening parts 45 provided at right and left sides of holding part 44, and a tightening part 48 of the unit 41 side corresponding to the tightening parts 45 are tightened together with bolts 50 for installation. In this method, too, the lower part of the unit 41 may be shaken by typhoon or vibrated by earthquake or the like to be exposed to impact.

SUMMARY OF THE INVENTION

The invention relates to an unit installation tool of a separate type air conditioner for installing the outdoor unit of the separate type air conditioner on an outer wall, which comprises;

- a yoke fitted to the outer wall with bolts,
- a holding part extended laterally for stopping a first engaging part, the holding part is disposed in the upper part of this yoke, the first engaging part provided in the upper part of the rear surface of the outdoor unit engaged from above, for stopping it from beneath, and
- a position keeping part for engaging a second engaging part provided beneath the first engaging part of the outdoor unit engaged from above, for defining the longitudinal move of the lower side of the outdoor unit, the second engaging part is provided below the first engaging part.

According to the outdoor unit installation tool (also called installation tool) of the separate type air conditioner of the present invention, first by fitting this installation tool to a specified position of the vertical member (i.e. outer wall) at the yoke by using bolts, then by engaging the holding part and position keeping part provided in the upper part and lower part of the yoke with the first engaging part and second engaging part in the upper and lower parts of the back side of the outdoor unit from above simultaneously, the upper part of the outdoor unit can be suspended by satisfying the necessary support rigidity and the deflection preventive rigidity in the fitting plane direction by engagement with the first engaging part corresponding to the range extended in the lateral direction of the holding part. Moreover, it is easy to install in the state of defining the longitudinal move of the lower part side of the outdoor unit around the suspending part by the engagement of the position keeping part and the second engaging part. Therefore, even in a higher floor of a high-rise building, within hands reach from the window, stairs, verandah, roof top or the like, such fitting job can be done easily, and the subsequent engaging job can be achieved easily. As a result, it is possible to install the air conditioner easily, safely, and in a short time.

In the constitution in which a pair of position keeping parts are provided so as to be positioned outward of the right and left ends of the holding parts, in the operation for putting the outdoor unit into the installation tool from almost straightly above, the second engaging part of the outdoor unit does not interfere with the holding part. Accordingly, the installation job of the outdoor unit is easier, and the pair of position keeping parts are provided at the right and left sides. As a result, preferably, the outdoor unit is not swayed to the right or the left.

The position keeping part has a support plate abutting against the back side of the outdoor unit, and this support plate has a notch extended laterally toward the upper direction fitted with the foot area having a head at the leading end of the second engaging part, and a working space is kept against the vertical member for bolting the support plate and outdoor unit, so that the same effect and action as above are obtained in this constitution. Further, by the play of the notch extending upward, the foot area of the second engaging part of the outdoor unit can be put in easily from above. Moreover, after putting in, by natural fall into the narrow lower part of the notch due to the weight of the outdoor unit, the outdoor unit can be positioned precisely and easily in the lateral direction. The second engaging part is composed of the bolt spirally fitted into the back side of the outdoor unit, and after installation of the outdoor unit, by inserting a tool or the like in the working space between the support plate and the vertical member, the bolt is manipulated and the outdoor unit can be tightened to the position keeping part. Therefore, the job is not so complicated, and the installation strength of the outdoor unit can be enhanced.

In the constitution in which the position keeping part is provided in a nearly middle height region of the outdoor unit, when installing the outdoor unit beneath the working position of window or the like, the engaging position of the position keeping part and second engaging part are close to the working position, and it is easy to reach by hand, so that the tightening job in this place is also done safely and easily from the working position.

BEST MODE OF CARRYING OUT THE INVENTION

Figure 1:
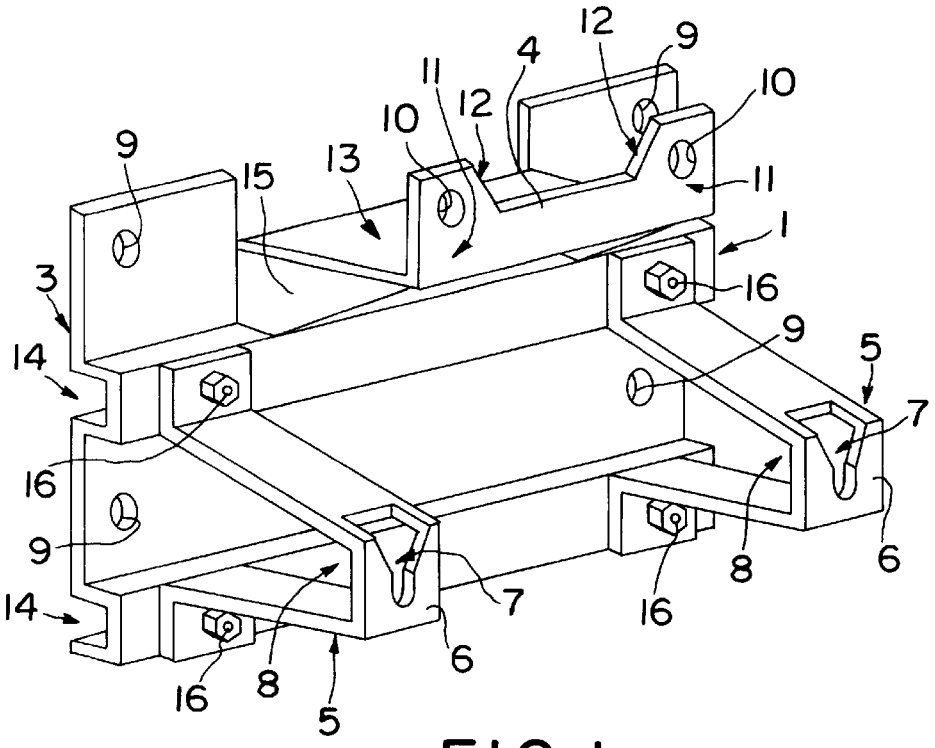
FIG. 1 is a perspective view showing an exemplary embodiment of an unit installation tool for an individual type air conditioner.

An exemplary embodiment of the present invention is described below while referring to the drawings.

Figure 2:
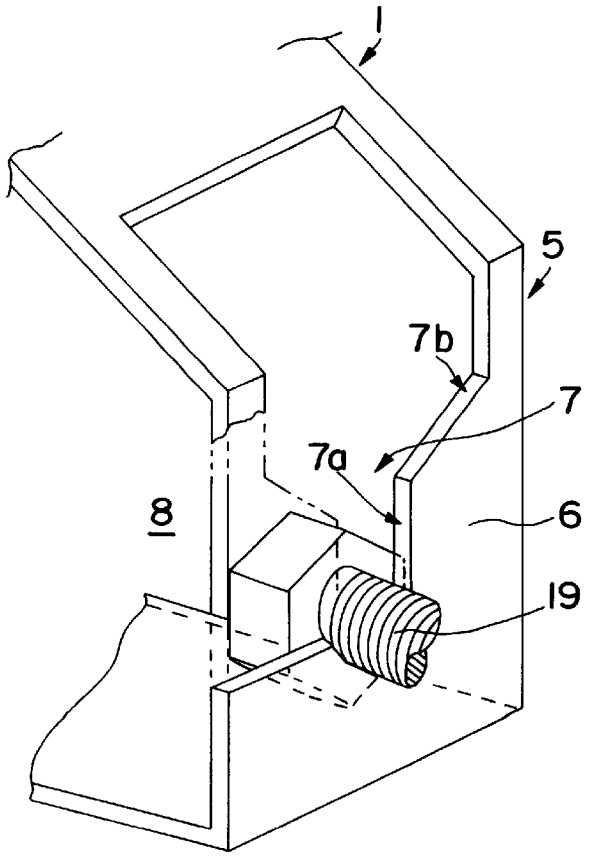
FIG. 2 is a partially magnified perspective view of the tool shown in FIG. 1.

An exemplary embodiment of an outdoor unit installation tool of a separate type air conditioner of the present invention includes a metal plate as shown in FIG. 1 and FIG. 2. The tool comprises a yoke 3 fitted to the wall with bolts, a laterally extended holding part 4 having the upper part of the yoke 3 projecting forward and folded upward, and a pair of right and left position holding parts 5 having the base part fastened to the yoke 3 beneath the holding part 4 with bolts 16.

Figure 3:
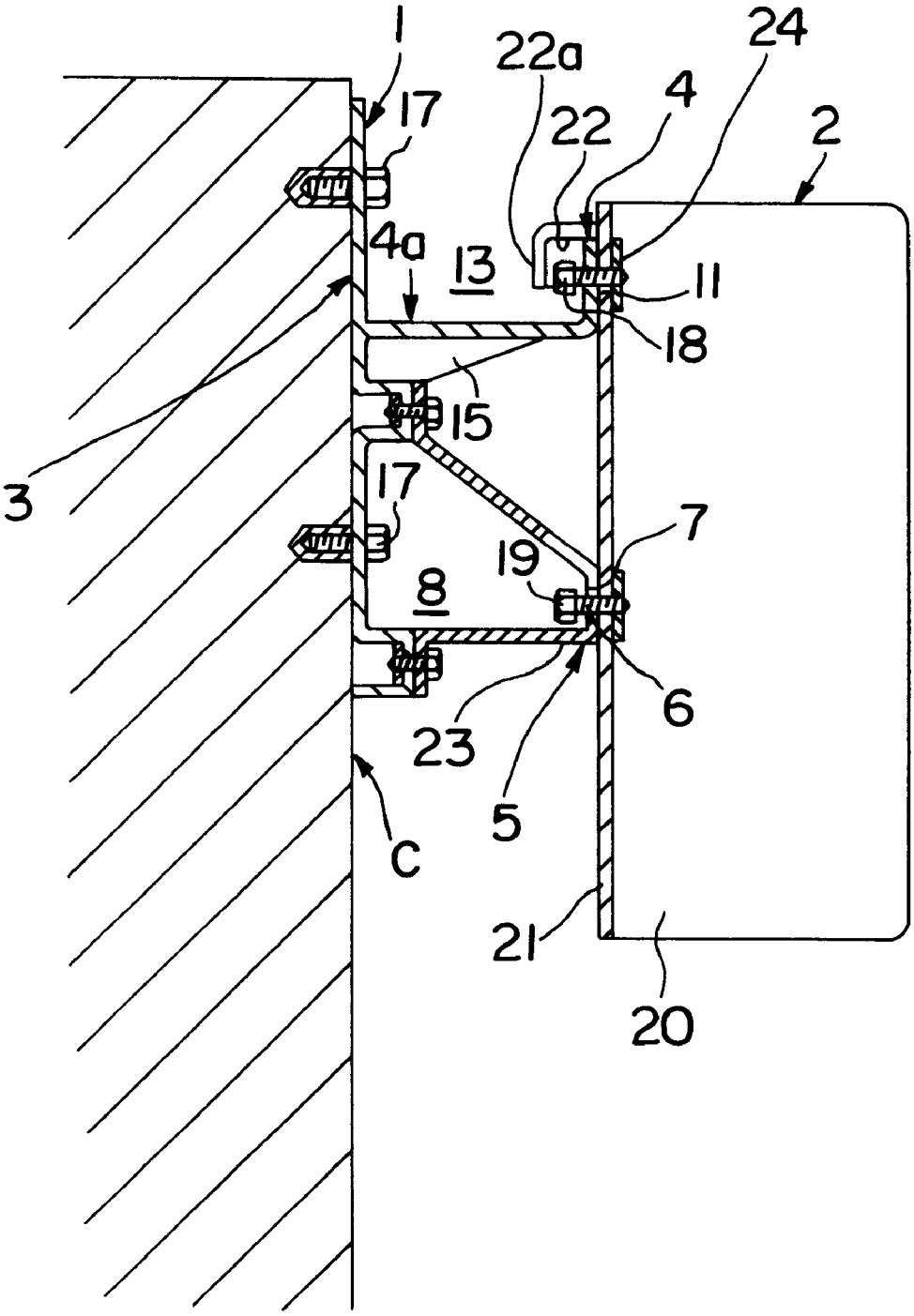
FIG. 3 is a sectional view showing a mode of use of the unit installation tool for individual type air conditioners in accordance with an exemplary embodiment of the present invention.
Figure 4:
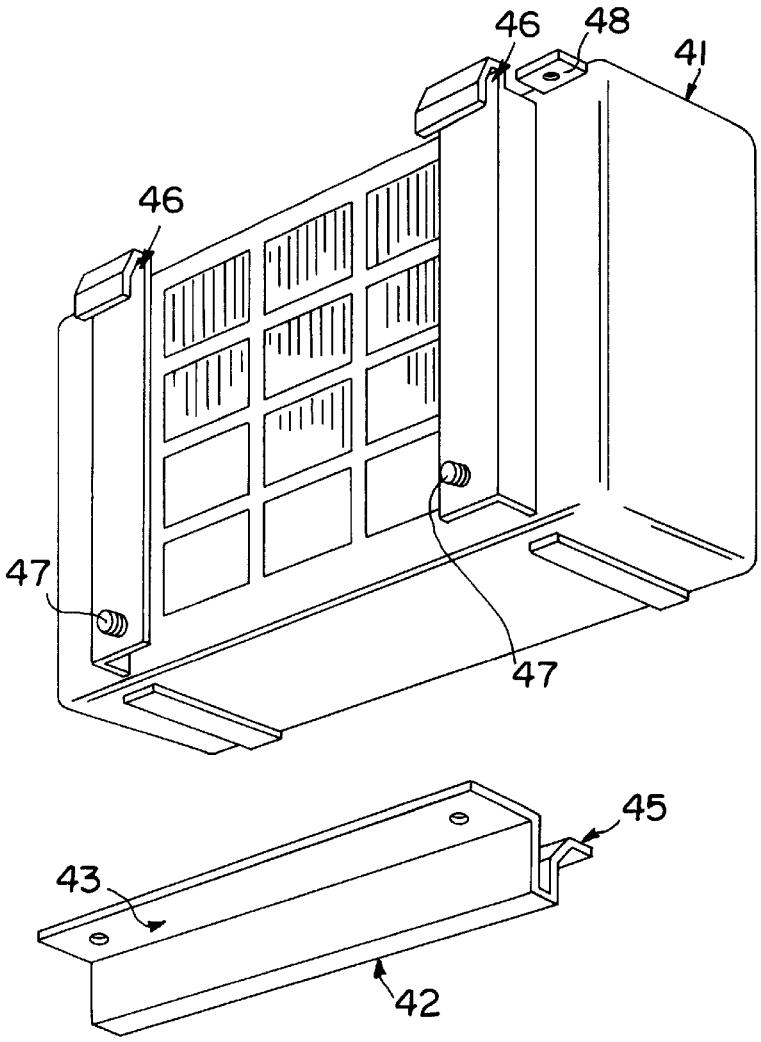
FIG. 4 PRIOR ART
FIG. 4 is a perspective view in accordance with the prior art.
Figure 5:
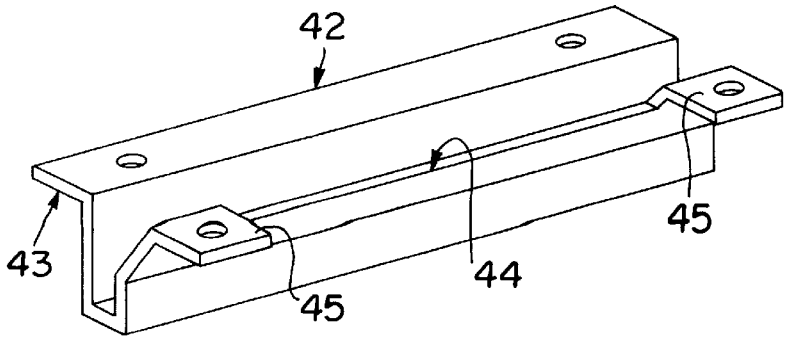
FIG. 5 PRIOR ART
FIG. 5 is a further perspective view in accordance with the prior art.
Figure 6:
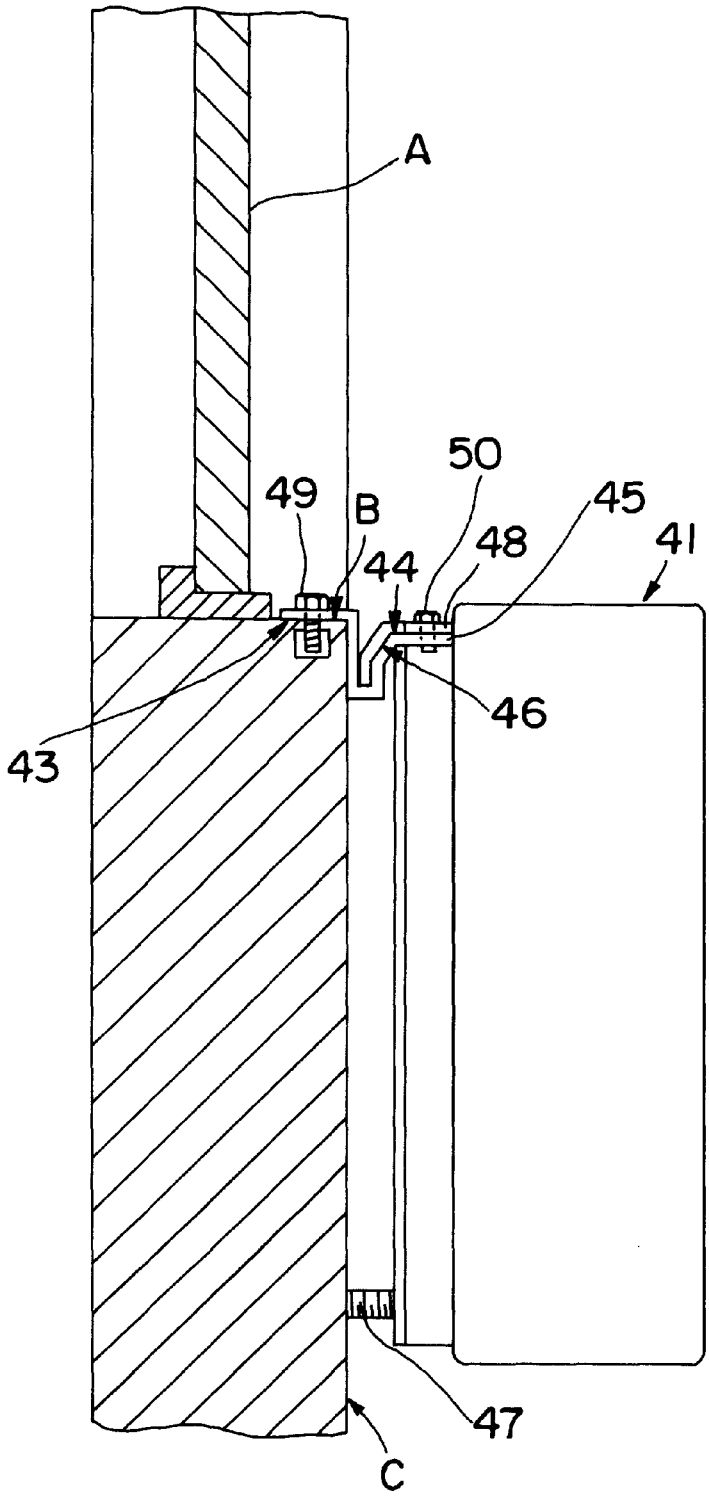
FIG. 6 PRIOR ART
FIG. 6 is a sectional view in accordance with the prior art.
Figure 7:
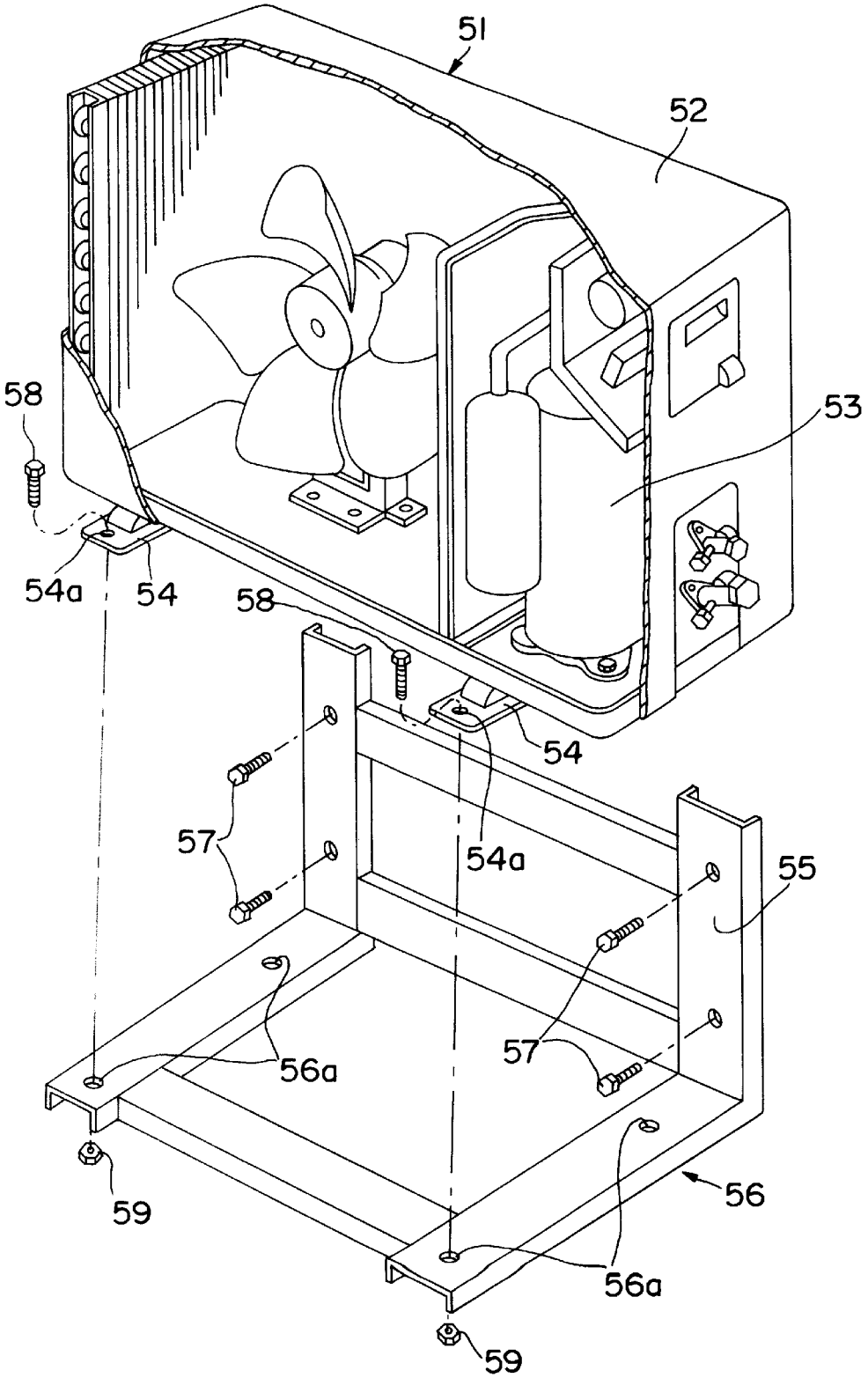
FIG. 7 PRIOR ART
FIG. 7 is yet a further perspective view showing the prior art.

An example of the outdoor unit 2 is shown in FIG. 3. The outdoor unit 2 comprises a first engaging part 22 provided integrally in the upper part of a back side 21 of its box 20 and released downward, and a second engaging part 23 composed of a bolt 19 spirally fitted in a middle height region of the unit 2 of the back side 21.

The unit 2 accommodates a compressor and other heavy objects (not shown) in the box 20. The first engaging part 22 in the upper part of the back side 21 of the box 20 supports the whole weight of the unit 2. To satisfy this requirement, in the exemplary embodiment, the first engaging part 22 is formed integrally in the upper part of a relatively thick back plate fitted to the back side 21 of the box 20. Not limited to this, however, the first engaging part 22 may be preliminarily provided in the upper part of the back side 21 of the box 20 by other mounting means. At the back side 21, a nut 24 is provided for tightening the unit 2 to the installation tool 1 near the first engaging part 22.

The installation tool 1 is designed to, as shown in FIG. 3, install the unit 2, for example, on the outer wall C beneath the window C.

The yoke 3 has four wall mounting holes 9 in the upper, lower, right and left positions, and is attached to the outer wall C beneath the window within a reaching range of hand from the window with four bolts 17. Channels 14 are formed by a plate bending process. The channels 14 accommodate the heads of bolts 16 mounting the position keeping part 5 therein, and also serve as reinforcing ribs for reinforcing the yoke 3.

In the holding part 4, a space 13 for putting in the leading end 22*a* of the first engaging part 22 of the unit 2 is formed by projecting the upper part of the yoke 3 forward and folding the upper part of yoke 3 upward. The first engaging part 22 is engaged with the upper side folded upward and extended laterally from above, and it is stopped from beneath, so that the whole weight of the unit 2 is supported. The upper part of a reinforcing metal plate 15 is welded to the lower side of a junction 4*a* of the holding part 4 and the yoke 3, and the lower part of this reinforcing metal plate 15 is welded to the front of the yoke 3. In this constitution, the holding part 4 is reinforced, and it receives the first engaging part 22 from beneath and supports the whole weight of the unit 2. It is engaged with the first engaging part 22, and it limits the movement of the first engaging part 22 in the longitudinal direction. Outward of the right and left sides of the holding part 4 are provided mounting parts 11, 11 having the metal plates extended upward further from the holding part 4. Inside of these mounting parts 11, 11, a set of right and left lateral guides 12, 12 for positioning the first engaging part 22 in the lateral direction are formed. In the engaging operation, the first engaging part 22 can be received easily and positioned precisely, so that suspension in a required range can be assured. In each center of the holding part 11, a mounting hole 10 is provided. A bolt 18 penetrates mounting hole 10 and read surface 21. The working space for tightening this bolt 18 to the nut 24 of the unit 2 is provided at right and left side of the space 13. The position of the mounting part 11 is not limited to the upper position of right or left side of the holding part 4 or to the extension from the holding part 4.

The position keeping part 5 is made of a pair of right and left metal plates having the base fastened to the front of the yoke 3 with bolts 16, The pair of right and left plates are provided beneath the holding part 4 so as to be positioned outward of the right and left ends, each having a support plate 6 projecting to the front side and abutting against the rear surface 21 of the unit 2. In the operation for installing the unit 2 from nearly right above, bolt 19 of the second engaging part 23 does not interfere with the holding part 4. The support plate 6 has a notch 7 extended upward and laterally, and a space 8 separating outerwall from notch 7 and the second engaging part 23 of the unit 2. The notch 7 includes, as shown in a magnified view in FIG. 2, a U-shaped notch 7*a* having a lateral width slightly larger than the axial diameter of the bolt 19, and a guide 7*b* extended upward and laterally from the upper end of this U-shaped notch 7*a*, so that it is easier to install from above the bolt 19 by the guide 7*b*. In the U-shaped notch 7*a*, as the front and back sides of the support plate 6 are held between the head of the bolt 19 and the back side 21 of the unit 2, the longitudinal move of the lower side of the unit 2 is defined. As the U-shaped notch 7*a* holds the shaft of the bolt 19 from the right and left sides, the unit 2 is positioned precisely in the lateral direction. By tightening the bolt 19, moreover, installation of the unit 2 is stronger.

By the constitution of the installation tool 1, the upper part of the unit 2 can be suspended by satisfying the necessary support rigidity and the deflection preventive rigidity in the fitting plane direction by engagement with the first engaging part 22 corresponding to the range extended in the lateral direction of the holding part 4. First this installation tool 1 is fitted to a specified position of the outer wall C at the yoke 3 by using bolts 17. Then the holding part 4 and position keeping part 5 provided in the upper part and lower part of the yoke 3 are engaged with the first engaging part 22 and second engaging part 23 in the upper and lower parts of the back side 21 of the unit 2 from above simultaneously. Moreover, it is easy to install in the state of defining the longitudinal move of the lower part side of the unit 2 around the suspending part by the engagement of the position keeping part 5 and the second engaging part 23. Therefore, even in a higher floor of a high-rise building, within hands reach from the window, stairs, verandah, roof top or the like, fitting can be done easily, and the subsequent engaging can be achieved easily. As a result, it is possible to install easily, safely, and in a short time.

In the exemplary embodiment, the position keeping part 5 is provided corresponding to the middle height region of the unit 2 of the back side 21 so as to be reached easily by hand from the window. Also, the second engaging part 23 is tightened to the position keeping part 5 by means of bolts 19. The invention is not limited to this embodiment. That is, it is sufficient for the position keeping part 5 to be engaged with the second engaging part 23, and the longitudinal movement of the lower side of the unit can be defined. In this case, when the upper mounting part 11 and the unit 2 are tightened with bolt 18 or tightened at least at one position, the engagement of the position keeping part 5 is not released easily. In this case, therefore, the position keeping part 5 may not always be in hands reach of the worker, and the second engaging part 23 may not always include bolt 19. It is enough to engage the holding part 4 and first engaging part 22 simultaneously from above the second engaging part 23.

The above description relates to air conditioners. It is understood, however, that the unit described above may be any type of unit for which attachment to a vertical member (such as an outside wall) is desired.

INDUSTRIAL APPLICABILITY

According to the unit installation tool of the individual type air conditioner of the present invention, first by fitting this installation tool to a specified position of the outer wall at the yoke by using bolts, and then by engaging the holding part and position keeping part provided in the upper part and lower part of the yoke with the first engaging part and second engaging part in the upper and lower parts of the back side of the unit from above simultaneously, the upper part of the unit can be suspended by satisfying the necessary support rigidity and the deflection preventive rigidity in the fitting plane direction by engagement with the first engaging part corresponding to the range extended in the lateral direction of the holding part. Moreover, it is easy to install in the state of defining the longitudinal movement of the lower part side of the unit around the suspending part by the engagement of the position keeping part and the second engaging part. Therefore, even in a higher floor of a high-rise building, within hands reach from the window, stairs, verandah, roof top or the like, such a fitting job can be done easily, and the subsequent engaging job can be achieved easily. As a result, it is possible to install easily, safely, and in a short time.

In the constitution in which a pair of position keeping parts are provided so as to be positioned outward of the right and left ends of the holding parts, in the operation for putting the unit into the installation tool from almost directly above, the second engaging part of the unit does not interfere with the holding part. Accordingly, the installation job of the unit is easier, and the pair of position keeping parts are provided at the right and the left. As a result, preferably, the unit is not swayed to the right or the left direction.

The position keeping part has a support plate abutting against the back side of the unit, and this support plate has a notch extended laterally toward the upper direction fitted with the foot area having a head at the leading end of the second engaging part, and a working space is kept against the outer wall for bolting the support plate and unit, so that the same effect and action as above are obtained in this constitution. Further, by the play of the notch extending upward, the foot area of the second engaging part of the unit can be put in easily. Moreover, after being put in, by natural fall into the narrow lower part of the notch due to the weight of the unit, the unit can be positioned precisely and easily in the lateral direction. The second engaging part is composed of the bolt spirally fitted into the back side of the unit, and after installation of the unit, by inserting a tool or the like in the working space between the support plate and the outer wall, the bolt is manipulated and the unit can be tightened to the position keeping part. Therefore, the job is not so complicated, and the installation strength of the unit can be enhanced.

In the constitution in which the position keeping part is provided in a nearly middle height region of the unit, when installing the unit beneath the working position of window or the like, the engaging position of the position keeping part and second engaging part are close to the working position, and it is easy to reach by hand, so that the tightening job in this place is also done safely and easily from the working position.

What is claimed is:

1. A unit installation tool for installing a unit of an individual type air conditioner to a vertical member, said unit having a first engaging part disposed at an upper part of a back side of said unit, a second engaging part disposed below said first engaging part disposed at said back side of said unit, comprising;

a yoke fitted to said vertical member with bolts, a holding part extended laterally for stopping said first engaging part from beneath, wherein said holding part is disposed in the upper part of said yoke, a position keeping part for engaging said second engaging part provided beneath said first engaging part of said unit engaged from above, for defining a distance between said vertical member and said unit, said position keeping part, said yoke and said holding part being mutually integrated, and a connecting means for defining a longitudinal movement of said unit, said connecting means disposed at at least one of said holding part and said position keeping part, wherein said first engaging part capable of being engaged from the upper side of said holding part, and said second engaging part capable of being engaged from the upper side of said position keeping part.

2. A unit installation tool of claim 1, wherein said position keeping part comprises of a pair of members provided to be positioned outward of the right and left ends of said holding part.

3. A unit installation tool of claim 2, wherein said position keeping part has a support plate abutting against the back side of said unit, said support plate has a notch extended upward and laterally fitted to a foot area having a head at a leading end of said second engaging part, and said support plate has a working space in front of said vertical member for bolting said support plate and said unit.

4. A unit installation tool of claim 1, wherein said position keeping part has a support plate abutting against the back side of said unit, said support plate has a notch extended upward and laterally fitted to a foot area having a head at a leading end of said second engaging part, and said support plate has a working space in front of said vertical member for bolting said support plate and said unit.

5. A unit installation tool according to claim 1, wherein said position keeping part is disposed corresponding to nearly a middle height region of said unit.

6. An installation tool for installing a unit of an individual type air conditioner to a vertical member said unit having a first engaging part disposed at an upper part of a back side of said unit, and a second engaging part disposed below said first engaging part disposed at said back side, said installation tool comprising;

(a) a yoke for fixing to said vertical member, (b) a holding part for holding by engaging with said first engaging part so as to receive the upper portion of said unit disposed from the upper direction, said holding part being disposed at a position projecting from said yoke so as to form a space, and (c) a position keeping part engaged with said second engaging part, for defining a distance between said vertical member and said unit, said position keeping part being disposed at a position projecting from said yoke so as to form a further working space, said position keeping part including a support part, said support part capable of abutting directly against a rear surface of said unit so as to define said distance between said vertical member and said unit.

7. An installation tool of claim 5, wherein said position keeping part has a first position keeping portion and a second position keeping portion disposed at both sides of said holding part.

8. An installation tool of claim 5, wherein said position keeping part has a support plate abutting against said back side of said unit, said support plate has a notch spreading to right and left in the upper direction, and said position keeping part is engaged with a second engaging part by a junction member passing through said notch.

9. An installation tool of claim 5, wherein said second engaging part is disposed at a position of nearly middle height of said unit, and said position keeping part is disposed at a position corresponding to said second engaging part.

10. An installation tool of claim 5, wherein said holding part and said position keeping part are disposed so that said position keeping part may be positioned, coinciding with said second engaging part, when said holding part supports said first engaging part of said outdoor unit.

11. An installation tool of claim 5, wherein said position keeping part and said yoke are fixed by a junction member.

12. An installation tool of claim 6, wherein said first engaging part includes a protrusion, said protrusion of said unit has a first U-shaped section bent in the upper direction, and a first recess of said protrusion is engaged with a second recess of said holding part, so that said holding part supports said unit.

13. The installation tool of claim 6, wherein said holding part including a mounting part, said mounting part is capable of abutting against a rear surface of said unit so as to define said distance between said vertical member and said unit.

14. The installation tool of claim 6, wherein said support part is capable of connecting directly to said rear surface of said unit so as to define a longitudinal movement of said unit.

15. The installation tool of claim 6, wherein said first engaging part is engaged from the upper side of said holding part, and said second engaging part is engaged from the upper side of said position keeping part.

16. The installation tool of claim 6, wherein said yoke is integrally disposed with at least one of said holding part and said position keeping part.

17. A method for installing a unit of an individual type air conditioner to a vertical member, comprising the steps of:

(a) supplying said unit having a first engaging part including a protrusion disposed at a back side, and a second engaging part disposed below said first engaging part disposed at said back side, (b) supplying an installation tool having a yoke for fixing on said vertical member, a holding part for holding said unit, and a position keeping part for defining the longitudinal move of said unit, (c) fixing said installation tool to said vertical member, by connecting said yoke to said vertical member by means of a first connection member, (d) mounting said unit having said first engaging part and said second engaging part on said installation tool from the upper direction of said installation tool fixed to said vertical member, so that said holding part supports said first engaging part from beneath, and said position keeps part being engaged with said second engaging part, (e) joining said holding part and said first engaging part by means of a second connection member, by working from a first working space formed between said yoke and said holding part, and (f) joining said position keeping part and said second engaging part by means of a third connection member, by working from a second working space formed between said yoke and said position keeping part.

18. An installation method of claim 17, wherein said protrusion of said unit has a first U-shaped section bent in the lower direction, said holding part has a second U-shaped section bent in the upper direction, and at step (d), a second recess formed by said second U-shaped section is engaged with a first recess formed by said first U-shaped section, so that said holding part supports said unit.

19. An installation method of claim 17, wherein said position keeping part has a right position keeping portion and a left position keeping portion disposed at both sides of said holding part, said second engaging part has a right engaging portion and a left engaging portion disposed in said unit, and at said step (d), said right position keeping portion and right engaging portion are engaged and said left position keeping portion and left engaging portion are engaged.

20. An installation method of claim 17, wherein said position keeping part has a support plate abutting against said back side of said unit, said support plate has a notch spreading to right and left in the upper direction, and at step (f), said third connection member is fixed to said second engaging part by passing through said notch from said third working space.

21. An installation method of claim 17, wherein at said step (d), said position keeping part is engaged with said second engaging part disposed at a position of nearly middle height of said unit.

22. An installation method of claim 17, wherein at least one connection member selected from the group consisting of said first connection member, second connection member and third connection member has a bolt.

23. An installation method of claim 17, wherein at said step (b), said installation tool is formed by a process of joining said position keeping part to said yoke by means of the bolt.

24. An installation tool for installing a unit of an individual type air conditioner to a vertical member, said unit having a first engaging part disposed at an upper part of a back side of said unit, and a second engaging part disposed below said first engaging part disposed at said back side of said unit, said installation tool comprising;

(a) a yoke for fixing to said vertical member, (b) a holding part for holding by engaging with said first engaging part so as to receive the upper portion of said unit disposed from the upper direction, said holding part being disposed at a position projecting from said yoke so as to form a space, said holding part including a mounting part, said mounting part capable of abutting directly against a rear surface of said unit so as to define said distance between said vertical member and said unit, and (c) a position keeping part engaged with said second engaging part, for defining a distance between said vertical member and said unit, said position keeping part being disposed at a position projecting from said yoke so as to form a further space.

25. The installation tool of claim 24, wherein said first engaging part includes a protrusion, said protrusion of said unit has a first U-shaped section bent in the upper direction, and a first recess of said protrusion is engaged with a second recess of said holding part, so that said holding part supports said unit.

26. The installation tool of claim 24, wherein said mounting part is capable of connecting directly to said rear surface of said unit so as to define a longitudinal movement of said unit.

27. The installation tool of claim 24, wherein said yoke is integrally disposed with at least one of said holding part and said position keeping part.

28. The installation tool of claim 24, wherein said first engaging part is engaged from the upper side of said holding part, and said second engaging part is engaged from the upper side of said position keeping part.

29. An installation tool for installing a unit of an individual type air conditioner to a vertical member, said unit having a first engaging part disposed at an upper part of a back side of said unit, and a second engaging part disposed below said first engaging part disposed at said back side of said unit, said installation tool comprising:

(a) a yoke for fixing to said vertical member, (b) a holding part for holding by engaging with said first engaging part so as to receive the upper portion of said unit disposed from the upper direction, said holding part being disposed at a position projecting from said yoke so as to form a space, said holding part including a mounting part, said mounting part capable of abutting directly against a rear surface of said unit so as to define said distance between said vertical member and said unit, and (c) a position keeping part engaged with said second engaging part, for defining a distance between said vertical member and said unit, said position keeping part being disposed at a position projecting from said yoke so as to form a further space, said position keeping part including a support part, said support part capable of abutting directly against a rear surface of said unit so as to define said distance between said vertical member and said unit.

30. The installation tool of claim 29, wherein said first engaging part includes a protrusion, said protrusion of said unit has a first U-shaped section bent in the upper direction, and a first recess of said protrusion is engaged with a second recess of said holding part, so that said holding part supports said unit.

31. The installation tool of claim 29, wherein said support part is capable of connecting directly to said rear surface of said unit so as to define a movement of said unit.

32. The installation tool of claim 29, wherein said mounting part is capable of connecting directly to said rear surface of said unit so as to define a movement of said unit.

33. The installation tool of claim 29, wherein said yoke, said holding part and said position keeping part are mutually integral.

34. The installation tool of claim 29, further comprising a connecting means for defining a movement of said unit, wherein said connecting means is disposed at at least one of said support part and said mounting part.

35. The installation tool of claim 29, wherein said first engaging part is engaged from the upper side of said holding part and said second engaging part is engaged from the upper side of said position keeping part.

* * * * *

UNITED STATES PATENT AND TRADEMARK OFFICE

CERTIFICATE OF CORRECTION

PATENT NO. : 6,135,402
DATED : October 24, 2000
INVENTOR(S) : Hatano et al

It is certified that error appears in the above-identified patent and that said Letters Patent is hereby corrected as shown below:

Column 7,
Line 47, delete "5" and insert -- 6 --.
Line 51, delete "5" and insert -- 6 --.
Line 60, delete "5" and insert -- 6 --.
Line 65, delete "5" and insert -- 6 --.

Column 8,
Line 4, delete "5" and insert -- 6 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*